US012631039B2

(12) United States Patent
Cord et al.

(10) Patent No.: US 12,631,039 B2
(45) Date of Patent: May 19, 2026

(54) METHOD FOR LOADING A FOUR-WHEELED VEHICLE AND ASSOCIATED TRANSPORT CONVEYOR

(71) Applicant: Stanley Robotics, Versailles (FR)

(72) Inventors: Aurélien Cord, Paris (FR); Anthony Trouble, Chaville (FR); Thomas Ravasi, Neuilly-sur-Marne (FR); Louis-Marie Dallen, Paris (FR)

(73) Assignee: Stanley Robotics, Versailles (FR)

( * ) Notice: Subject to any disclaimer, the term of this patent is extended or adjusted under 35 U.S.C. 154(b) by 357 days.

(21) Appl. No.: 18/254,580

(22) PCT Filed: Nov. 30, 2021

(86) PCT No.: PCT/FR2021/052144
§ 371 (c)(1),
(2) Date: May 25, 2023

(87) PCT Pub. No.: WO2022/117945
PCT Pub. Date: Jun. 9, 2022

(65) Prior Publication Data

US 2024/0102307 A1 Mar. 28, 2024

(30) Foreign Application Priority Data

Dec. 2, 2020 (FR) ..... 2012512

(51) Int. Cl.
*E04H 6/30* (2006.01)

(52) U.S. Cl.
CPC ..... *E04H 6/305* (2013.01)

(58) Field of Classification Search
CPC .... E04H 6/24; E04H 6/36; E04H 6/30; E04H 6/305; B60S 13/00
See application file for complete search history.

(56) References Cited

U.S. PATENT DOCUMENTS

| | | | | |
|---|---|---|---|---|
| 10,590,669 | B2 * | 3/2020 | Boussard | E04H 6/182 |
| 11,312,415 | B2 * | 4/2022 | Tzivanopoulos | B60S 13/00 |
| 11,981,554 | B2 * | 5/2024 | Cord | B66F 9/0755 |

FOREIGN PATENT DOCUMENTS

| | | |
|---|---|---|
| DE | 202004018058 | 2/2005 |
| FR | 3090541 A1 | 6/2020 |

OTHER PUBLICATIONS

International Search Report for International Application No. PCT/FR2021/052114 dated Jan. 25, 2023, 2 pages.
International Written Opinion for International Application No. PCT/FR2021/052114 dated Jan. 25, 2023, 5 pages.

* cited by examiner

*Primary Examiner* — Mark C Hageman
(74) *Attorney, Agent, or Firm* — TraskBritt

(57) ABSTRACT

A method for loading a four-wheeled vehicle using a transporter comprising wedging arms that are arranged so as to be positioned on either side of the tread of a wheel of the vehicle to be loaded, and wheel clamping detection means, the method comprising the following steps: —a step of moving the transporter until a wedging arm comes into contact with the tread of a tire, —a step of moving the transporter along the longitudinal axis of the transporter for a predetermined distance or until a predetermined force is detected, —a step of stopping the transporter from moving and generating a signal representative of the mobility state of the vehicle: moving or stationary.

12 Claims, 5 Drawing Sheets

METHOD FOR LOADING A FOUR-WHEELED VEHICLE AND ASSOCIATED TRANSPORT CONVEYOR

CROSS-REFERENCE TO RELATED APPLICATIONS

This application is a national phase entry under 35 U.S.C. § 371 of International Patent Application PCT/FR2021/052144, filed Nov. 30, 2021, designating the United States of America and published as International Patent Publication WO 2022/117945 A1 on Jun. 9, 2022, which claims the benefit under Article 8 of the Patent Cooperation Treaty to French Patent Application Serial No. FR2012512, filed Dec. 2, 2020.

TECHNICAL FIELD

The present disclosure relates to the field of electric handling vehicles, in particular, four-wheeled vehicle transporters.

BACKGROUND

In the state of the art, it is known practice to use electric transporters to move or transport motor vehicles, in particular, new vehicles, over parking areas.

However, if the parking brake of a vehicle is not actuated, the vehicle could unintentionally roll down a slope after movement via a transporter. In the worst case, the vehicle could hit other stored vehicles and cause damage. It would also be desirable to provide a solution that allowed tolerance in the positioning, in three dimensions, of the transporter relative to the vehicle to be transported or moved.

BRIEF SUMMARY

In its most general sense, the present disclosure relates to a method for loading a four-wheeled vehicle using a transporter comprising wedging arms that are arranged so as to be positioned on either side of the tread of a wheel of the vehicle to be loaded, and means for detecting the presence or clamping of a wheel, the method comprising the following steps:

- a step of moving the transporter until a wedging arm comes into contact with the tread of a tire,
- a step of moving the transporter along the longitudinal axis of the transporter for a predetermined distance or until a predetermined force is detected,
- a step of stopping the transporter from moving and generating a signal representative of the mobility state of the vehicle: moving or stationary.

It is thus straightforward and quick to check the actuation state of the parking brake of the vehicle to be loaded or moved while allowing a tolerance of several degrees relative to the longitudinal axis of the vehicle.

According to a first variant, the step of stopping the movement of the transporter and of generating a signal representative of the mobility state of the vehicle is carried out according to the change in a detected force with time. The predetermined force is, for example, a force corresponding to an increase of at least 30% in the detected force as a wedging arm comes into contact with a tread. If the detected force disappears after the step of stopping the movement of the transporter, the loading of the vehicle is interrupted.

According to a second variant, the step of stopping the movement of the transporter and of generating a signal representative of the mobility state of the vehicle is carried out according to the change in a detected distance with time. If the detected distance increases after the step of stopping the movement of the transporter, the loading of the vehicle is interrupted.

If loading is interrupted, a message is transmitted.

The present disclosure, according to a second aspect, relates to a transporter for loading four-wheeled vehicles, comprising a telescopic chassis comprising wedging arms that are arranged so as to be positioned on either side of the tread of a wheel of the vehicle to be loaded, wherein the transporter comprises means for detecting the presence or clamping of a vehicle wheel comprising at least one sensor and a presence or clamping detection computer that collects the data from the at least one sensor and generates a signal representative of the mobility state of the vehicle according to the data.

Preferably, the transporter is of the type comprising a chassis that is telescopic in a longitudinal direction, the chassis comprising a main beam and a secondary beam that is movable relative to the main beam, each beam comprising a side member that extends transversely on either side of the beam, each side member having a pair of arms that are pivotably to the longitudinal member, each arm being connected to one end of a side member. The arms are movable between a position in which they allow the chassis to move under the vehicle, and a position in which they come into contact with the treads of the wheels. Each arm is pivotably connected on a pivot shaft to allow movement between a position in which the arm is perpendicular to the longitudinal axis of the chassis and a folded position in which the arm occupies a width that is less than the distance between the inner walls of the wheels of the vehicle. In the perpendicular position, also called the unfolded position, the length of the assembly comprising the pair of arms and a side member is at least equal to the track of the vehicle to be loaded or moved.

The height of the chassis, comprising elements borne thereby, and for the portion that is intended to be deployed under the vehicle to be transported, is designed to be less than the ground clearance of the vehicle.

According to one alternative embodiment of the chassis of the transporter, the pair of pivotably connected arms is transversely movable.

According to a first embodiment of the presence or clamping detection means, these means comprise means for detecting the position of a wheel. For example, the means for detecting the position of a wheel are laser, ultrasonic or radar rangefinding sensors. According to one alternative embodiment, the presence or clamping detection means are contact detection means. For example, the contact detection means comprise at least one spring.

According to a second embodiment of the presence or clamping detection means, these means comprise means for detecting a force. For example, the means for detecting a force are force sensors such as strain gages or pressure probes, or else interpret an indirect signal such as, for example, the increase in the power consumption of clamping cylinder motor.

Preferably, the presence detection or clamping means are arranged on the wedging arms.

In a complementary manner or according to another embodiment, the clamping detection means are arranged on the pivot shafts of the wedging arms.

In connection with the preceding embodiment, the means for detecting a force comprise a torque sensor and/or a sensor for measuring the strength of the one or more electric actuators that actuate the one or more wedging arms.

BRIEF DESCRIPTION OF THE DRAWINGS

The present disclosure will be better understood from reading the following description, which refers to a non-limiting exemplary embodiment illustrated by the accompanying drawings, in which.

DETAILED DESCRIPTION

Figure 1:
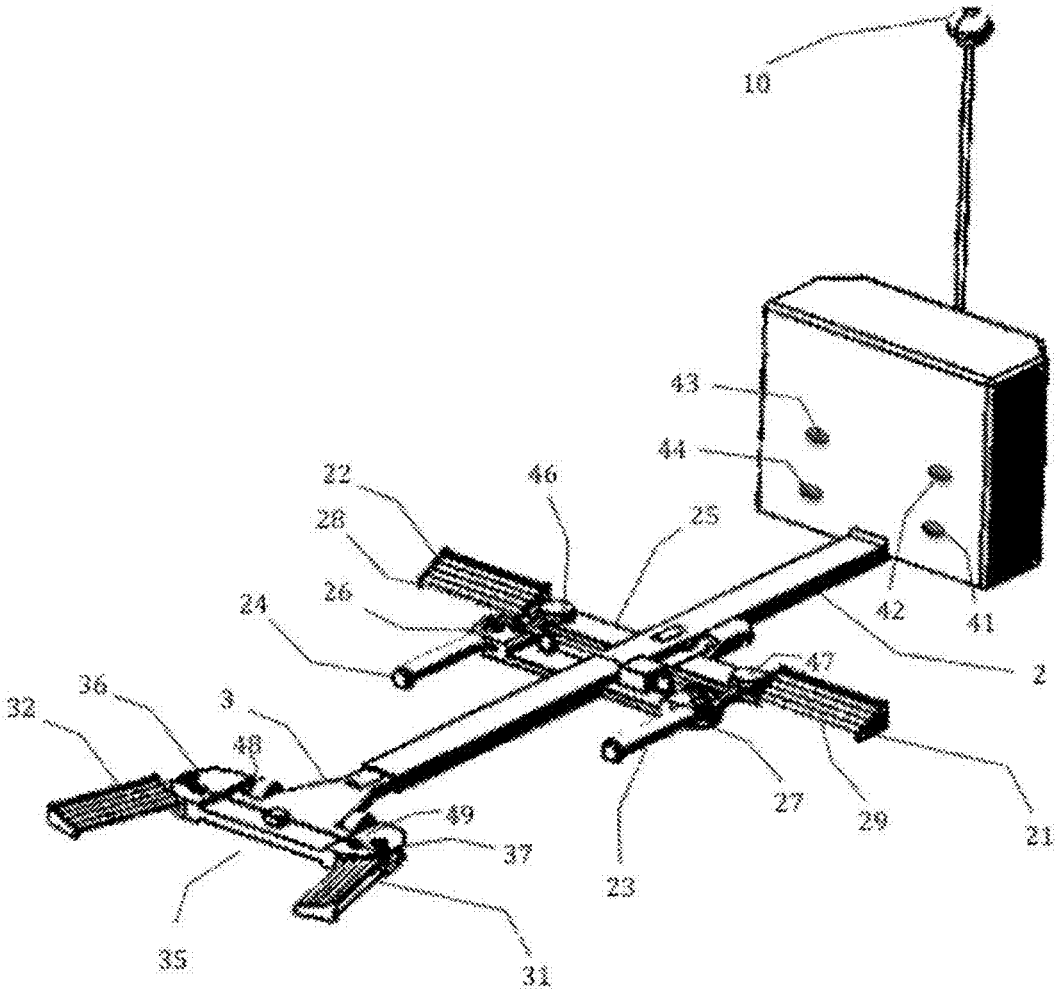
FIG. 1 shows a schematic perspective view of a transporter according to a first exemplary embodiment of the present disclosure, the transporter comprising two pairs of front wedging arms and one pair of rear wedging arms.

FIG. 1 shows a perspective view of a first embodiment of a transporter. The transporter comprises a chassis comprising a main beam 2 and a secondary beam 3 that is mounted slidably inside the main beam 2. A cylinder or a linear actuator (not shown), for example, a worm gear actuator, allows the secondary beam 3 to be actuated relative to the main beam 2 in order to obtain a telescopic chassis.

The main beam 2 of the chassis comprises a front transverse side member 25, which is fixed and which bears two fixed arms 21, 22 and two deployable front arms 23, 24, which are pivotably movable relative to the front side member. The deployable front arms 23, 24 are actuated by electric motors or cylinders, in order to move between:

- a neutral position, in which the deployable front arms extend parallel to the main beam in order to allow the transporter to drive under the vehicle to be loaded without touching the wheels of the vehicle; and
- a deployed locking position, in order to allow contact with the treads of the wheels of the vehicle.

In the deployed position, the spacing between each pair consisting of a fixed arm and a facing deployable arm 21, 23 and 22, 24 is determined so that they come into contact with the front and rear walls of the tire of the vehicle and grip the tire in order to allow the vehicle to be lifted. To facilitate lifting, the fixed arms 21, 22 have an inclined ramp 28, 29.

When the deployable front arms 24, 23 are in the deployed locking position, they stop the vehicle from moving relative to the transporter.

The secondary beam 3 of the chassis likewise comprises a rear transverse side member 35, which bears two deployable rear wedging arms 31, 32 that are pivotally movable relative to the rear side member. The deployable rear wedging arms 31, 32 are actuated by electric motors or cylinders, in order to move between:

- a neutral position, in which the deployable rear arms extend parallel to the secondary beam in order to allow the transporter to drive under the vehicle to be loaded without touching the wheels of the vehicle; and
- a deployed locking position, in order to allow contact with the treads of the wheels of the vehicle.

The length L of the side members 25, 35, measured between the pivot shafts of the deployable front arms 23, 24 and of the deployable rear wedging arms 31, 32 is less than Vmin−Lmin, where:

- Vmin denotes the typical and minimum track of a car, typically 1600 millimeters,
- Lmin denotes the typical width of the tire of a car, typically 220 millimeters.

The length 1 of the side members is therefore typically less than 1400 millimeters, and preferably about 1200 millimeters.

The length of the fixed arms 21, 22, of the deployable front arms 23, 24 and of the deployable rear wedging arms 31, 32 is determined so as to correspond to half of the width lmax, which corresponds to the width between the outer walls of the wheels of a large car, minus the length of the side member 25, 35, which is typically 500 millimeters for each of the arms.

The transporter may thus be positioned along the axis of the vehicle in order to allow the chassis of the transporter to pass under the vehicle with the wedging arms 23, 24, 31, 32 in the folded position, oriented substantially longitudinally, until the ramps 28, 29 of the fixed arms 21, 22 abut the front wheels of the vehicle.

The deployable wedging arms 31, 32 are then moved into the transverse position. The secondary beam of the chassis is actuated forward in order to adjust to the wheelbase of the car to be loaded and to bring the deployable wedging arms 31, 32 into contact with the rear treads of the wheels of the vehicle.

The wedging arms 23, 24 are deployed to move the vehicle onto the fixed arms 21, 22.

The transporter comprises four ultrasonic rangefinding sensors 41 to 44 that deliver signals according to the distance from the bumper of the vehicle.

The transporter comprises means for detecting the clamping of a vehicle wheel comprising at least one sensor and a clamping detection computer that collects the data from the at least one sensor and generates a signal representative of the mobility state of the vehicle according to the data.

According to one embodiment and with reference to FIG. 1, the clamping detection means comprise two force sensors 46, 47 that are intended to detect and validate that the vehicle has been loaded, and two short-range laser rangefinding sensors 26, 27 for detecting the wheels and obstacles. The four sensors are arranged on the front side member 25.

Additionally, the wheel presence detection means comprise two short-range laser rangefinding sensors 48, 49 for detecting the wheels and obstacles. The two laser rangefinding sensors 48, 49 are arranged on the rear side member 35.

According to some alternative embodiments:

force sensors may be arranged on the two side members, sensors for detecting the position of a wheel may be arranged on one of the two side members, one or more of the sensors may be arranged on the wedging arms.

The chassis formed by the beams 2, 3 and the side members 25, 35 has wheels or rollers to allow it to move over the ground.

FIGS. 2 to 7 show schematic views of the vehicle and of the transporter in successive loading steps.

Figure 2:
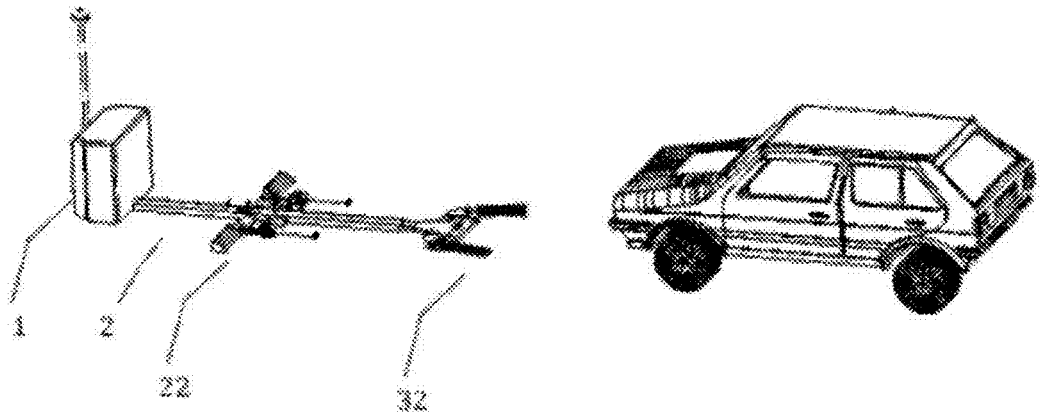
FIG. 2 shows a schematic perspective view of a transporter according to FIG. 1 in the approach phase in front of a motor vehicle.

At the start, as shown in FIG. 2, the transporter is positioned in front of the car, which is parked in a storage space, so that it is substantially aligned with the vehicle. The movable wedging arms 23, 24, 31, 32, 33, 34 are in the folded or neutral position.

The short-range laser rangefinders 48, 49 detect the first set of wheels of the vehicle so as to position the chassis of the transporter relative to the vehicle to be loaded.

Figure 3:
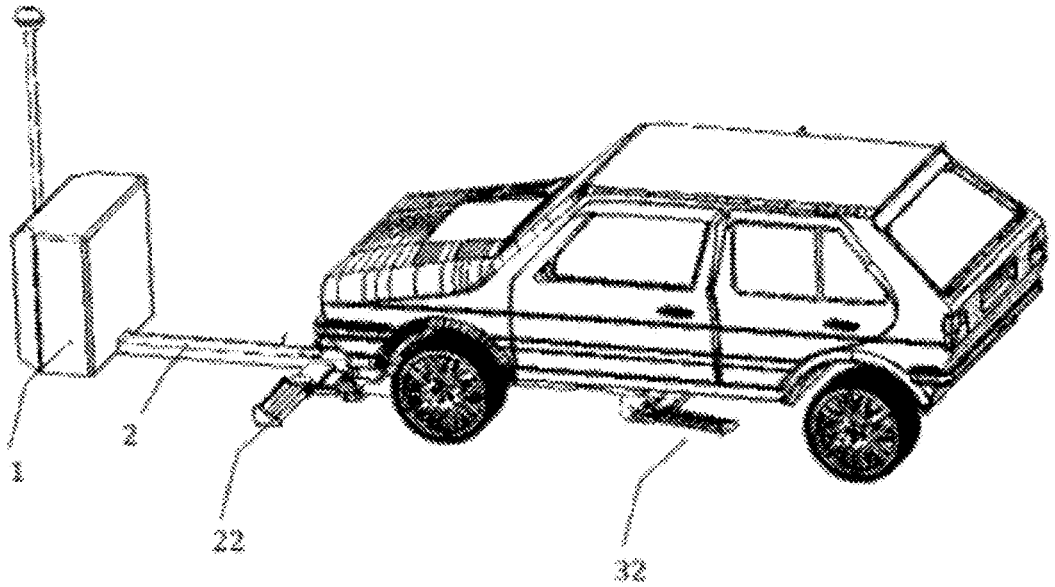
FIG. 3 shows a schematic perspective view of a transporter in the approach phase in which the chassis of the transporter is located partly under a motor vehicle, and the rear wedging arms are in the folded position.
Figure 4:
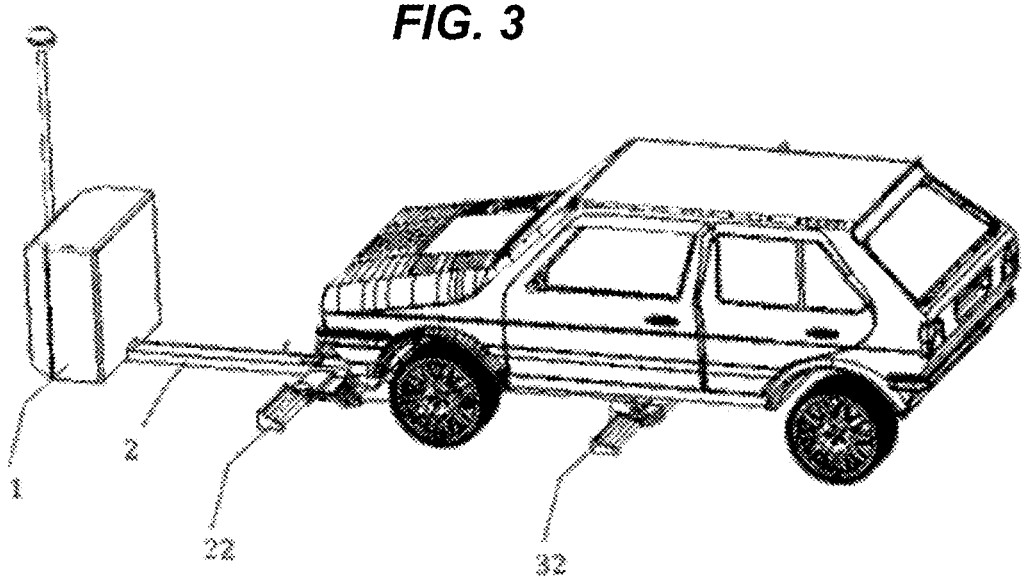
FIG. 4 shows a view of a transporter according to FIG. 3, the rear wedging arms being in the unfolded position.

Next, the transporter moves so as to position the secondary beam, and then the main beam, under the vehicle until the front wheels of the vehicle are detected by the short-range laser rangefinders 26, 27; see FIG. 3.

In the next step (FIG. 4), the rear wedging arms 31, 32 are deployed into the transverse position. In the context of a test for checking that the parking brake of the vehicle is properly locked, the wedging arms could retain the vehicle if the parking brake was not locked.

Figure 5:
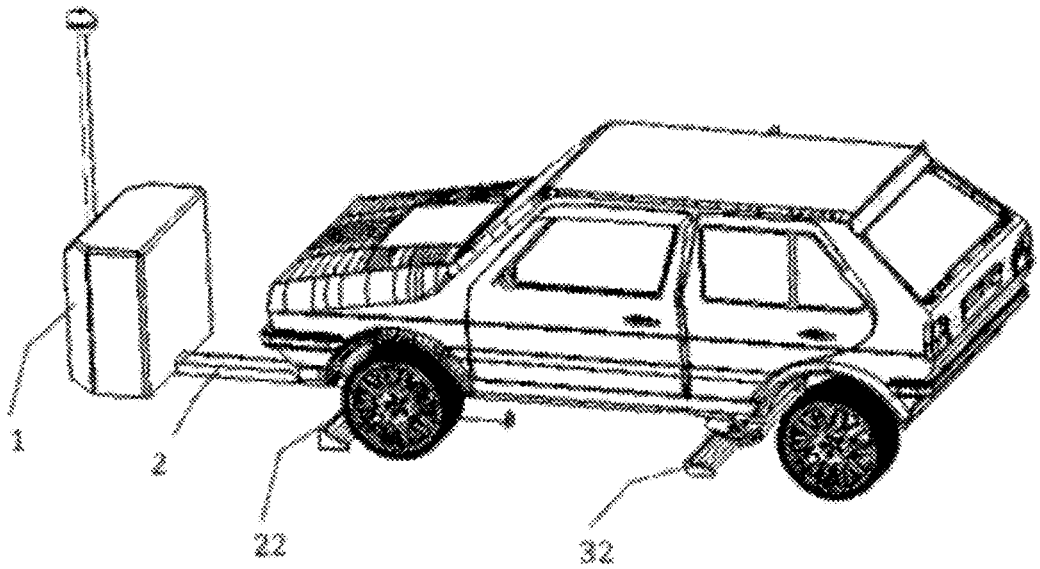
FIG. 5 shows a schematic perspective view of a transporter in the approach phase in which the chassis of the transporter is located under a motor vehicle, and the front wedging arms are in contact with the treads of the front wheels of the motor vehicle.
Figure 6:
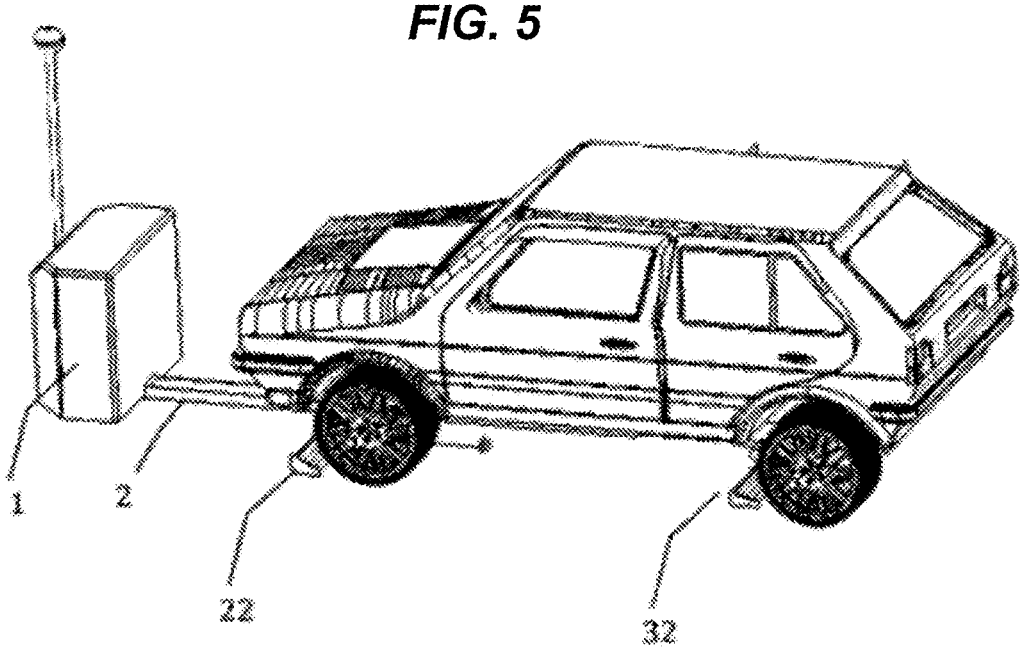
FIG. 6 shows a view of a transporter according to FIG. 5, the rear wedging arms being in contact with the treads of the rear wheels of the motor vehicle.

The transporter then moves forward until the front fixed arms 21, 22 come into contact with the front wheels (see FIG. 5). The force sensors 46, 47 and the short-range laser rangefinders 26, 27 indicate that the wheels are in contact. In addition, the secondary beam is deployed until the rear wheels of the vehicle are detected by the short-range laser rangefinders 48, 49.

In order to detect that the wheels are properly clamped, and therefore that the parking brake is properly locked, the transporter moves along the longitudinal axis of the transporter so that the force sensors 46, 47 detect an increase in force relative to the force detected when detecting contact with the wheels. As soon as this force is detected, the transporter stops moving.

If the force sensors 46, 47 detect substantially the same increased force and/or if the position sensors 26, 27 continue to detect contact with the wheels, then the clamping detection computer indicates that the parking brake is indeed locked and the loading procedure continues.

If the force sensors 46, 47 detect a decrease in force and/or if the position sensors 26, 27 detect a gap from the wheels, in particular, an increasing gap, then the clamping detection computer indicates that the parking brake is not locked and the loading procedure is interrupted.

If the parking brake is indeed locked, the transporter then adjusts (FIG. 6) the length of the secondary beam so that the rear wedging arms 31, 32 come into contact with the rear wheels. Once the deployable front arms 23, 24 have clamped the front wheels, the vehicle is lifted.

Figure 7:
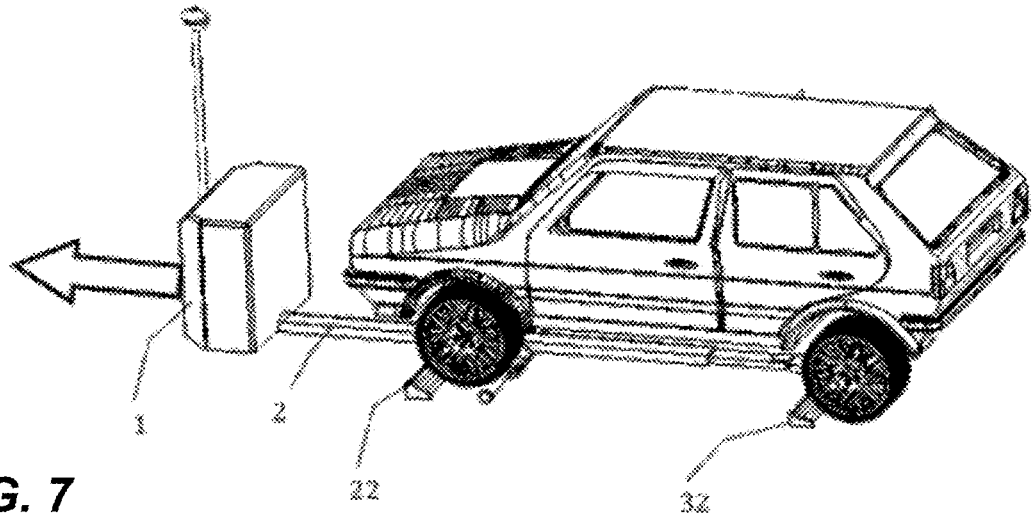
FIG. 7 shows a view of a transporter according to FIG. 6, the motor vehicle having been loaded on the transporter.
Figure 8:
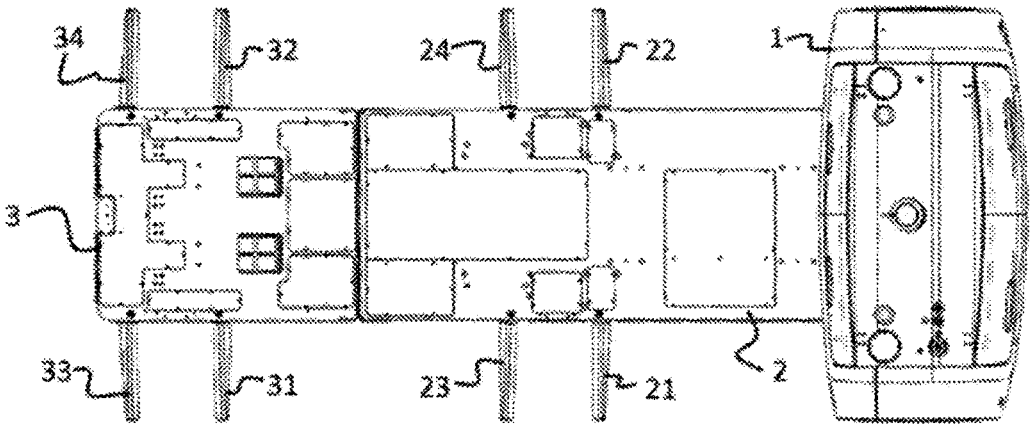
FIG. 8 shows a schematic top view of a transporter according to a second embodiment of the present disclosure, the transporter comprising two pairs of front wedging arms and two pairs of rear wedging arms.

The force sensors 46, 47 validate that the vehicle is mounted on the fixed wedging arms 21, 22, and the transporter is moved automatically to bring the vehicle to the target location; see FIG. 7.

With reference to FIGS. 8, 9, 10 and 11, a second embodiment of a transporter will now be described in terms of its differences with respect to the first embodiment.

Figure 9:
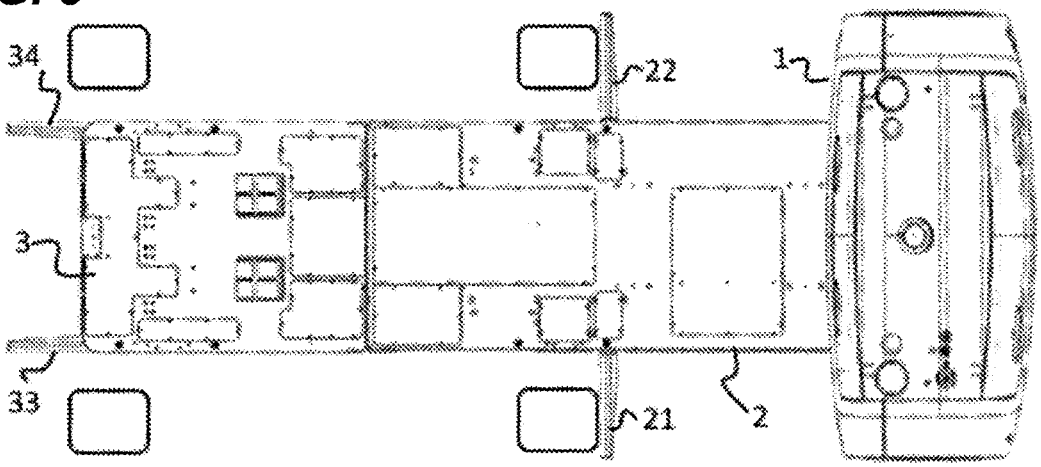
FIG. 9 shows a schematic top view of a transporter according to FIG. 8 in the approach phase in front of a motor vehicle, only the wheels of which are shown.

The secondary beam 3 of the chassis further comprises two deployable distal arms 33, 34 that are pivotally movable relative to the rear side member. The deployable distal arms 33, 34 are actuated by electric motors or cylinders, in order to move between:

with reference to FIG. 9, a neutral position, in which the deployable distal arms 33, 34 extend parallel to the secondary beam 3 in order to allow the transporter to drive under the vehicle to be loaded without touching the wheels of the vehicle (the deployable rear arms are in the folded position and are not visible in FIG. 9); and a deployed locking position, in order to allow contact with the treads of the wheels of the vehicle.

In the deployed position, the spacing between each clamping pair consisting of a rear arm and a facing distal arm 31, 33 and 32, 34 is determined so that they come into contact with the front and rear walls of the tire of the vehicle and grip the tire in order to allow the vehicle to be lifted. When the deployable distal arms 34, 33 are in the deployed locking position, they stop the vehicle from moving relative to the transporter.

With reference to FIG. 9, the transporter is positioned under a car in a substantially parallel manner, the car being represented by four squares illustrating the tires of the car. The movable wedging arms 23, 24, 31, 32, 33, 34 are in the folded or neutral position.

The short-range laser rangefinders positioned on the secondary beam 3 detect the front wheels of the vehicle so as to position the chassis of the transporter relative to the vehicle to be loaded, before the short-range laser rangefinders positioned on the main beam 2 then detect the front wheels of the vehicle until the front fixed arms 21, 22 come into contact with the front wheels (see FIG. 9). The force sensors and the short-range laser rangefinders, positioned on the main beam 2, indicate that the wheels are in contact.

Figure 10:
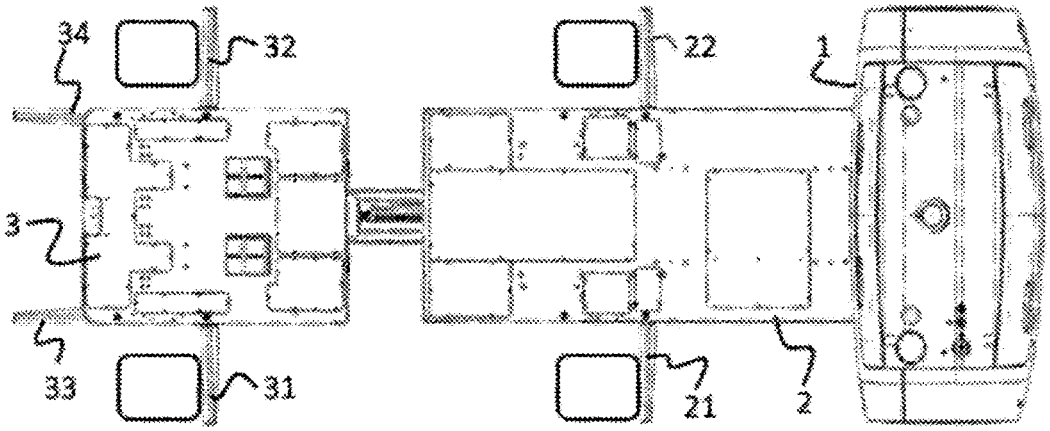
FIG. 10 shows a schematic top view of a transporter according to FIG. 8, the rear wedging arms being in contact with the treads of the rear wheels of the motor vehicle, and the distal wedging arms being in the folded position.

Next, with reference to FIG. 10, the secondary beam 3 is deployed until the rear wheels of the vehicle are detected by the short-range laser rangefinders borne by the beam 3. The rear wedging arms 31, 32 are deployed into the transverse position.

In order to detect that the wheels are properly clamped, and therefore that the parking brake is properly locked, the transporter moves along the longitudinal axis of the transporter so that the force sensors detect an increase in force relative to the force detected when detecting contact with the wheels. As soon as this force is detected, the transporter stops moving.

If the force sensors detect substantially the same increased force and/or if the position sensors continue to detect contact with the wheels, then the clamping detection computer indicates that the parking brake is indeed locked and the loading procedure continues.

If the force sensors detect a decrease in force and/or if the position sensors detect a gap from the wheels, in particular, an increasing gap, then the clamping detection computer indicates that the parking brake is not locked and the loading procedure is interrupted.

If the parking brake is indeed locked, the transporter then adjusts the length of the secondary beam.

Figure 11:
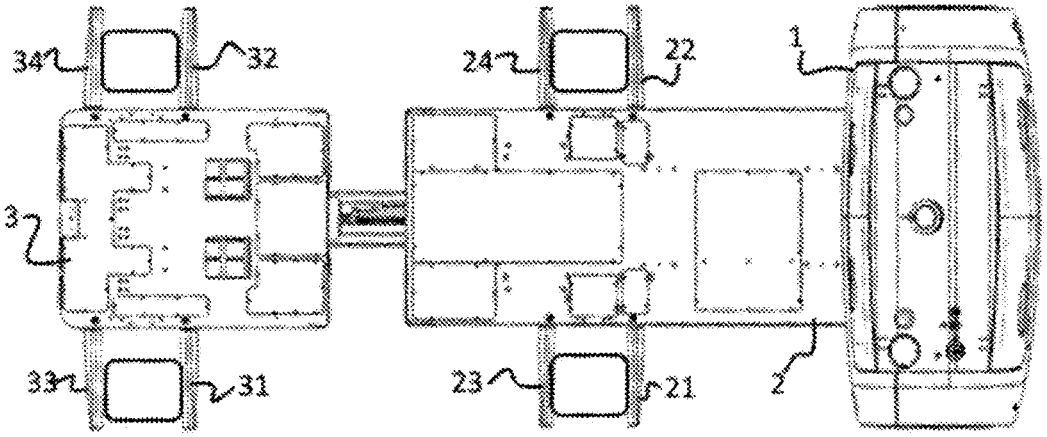
FIG. 11 shows a schematic top view of a transporter according to FIG. 8, in which all of the wedging arms are in contact with the wheels of the motor vehicle to be loaded.

Next, with reference to FIG. 11, the front wedging arms 23, 24 and the distal wedging arms 33, 34 are deployed in order to clamp the wheels of the vehicle before lifting the vehicle. The force sensors validate that the vehicle is mounted on the wedging arms.

The invention claimed is:

1. A method for loading a four-wheeled vehicle using a transporter comprising wedging arms that are arranged so as to be positioned on either side of the tread of a wheel of the vehicle to be loaded, and means for detecting a distance to a wheel or a force from contact with a wheel, the method comprising:

moving the transporter until a wedging arm comes into contact with the tread of a tire;

moving the transporter along a longitudinal axis of the transporter for a predetermined distance or until a predetermined force is detected; and stopping the transporter from moving and generating a signal representative of a mobility state of the vehicle, the mobility state being either moving or stationary.

2. The method of claim 1, wherein the stopping of the transporter from moving and generating the signal representative of the mobility state of the vehicle is carried out according to a change in a detected force with time from contact with a wheel.

3. The method of claim 2, wherein the loading of the vehicle is interrupted if the detected force from contact with the wheel disappears after the stopping of the transporter from moving.

4. The method of claim 3, wherein a message is transmitted if loading is interrupted.

5. The method of claim 1, wherein the stopping of the transporter from moving and generating the signal representative of the mobility state of the vehicle is carried out according to a change in a detected distance to a wheel with time.

6. The method of claim 5, wherein the loading of the vehicle is interrupted if the detected distance to the wheel increases after the stopping of the transporter from moving.

7. The method of claim 6, wherein a message is transmitted if loading is interrupted.

8. An electric transporter for loading four-wheeled vehicles, comprising:

a telescopic chassis comprising wedging arms arranged so as to be positioned on either side of a tread of a wheel of a vehicle to be loaded; and means for detecting a presence or clamping of a vehicle wheel comprising at least one sensor and a presence or clamping detection computer that collects data from the at least one sensor and generates a signal representative of the mobility state of the vehicle according to the data.

9. The transporter of claim 8, wherein the at least one sensor is configured for detecting the position of a wheel.

10. The transporter of claim 8, wherein the at least one sensor is configured for detecting a force.

11. The transporter of claim 10, wherein the presence or clamping detection means are arranged on the wedging arms.

12. The transporter of claim 8, wherein the presence or clamping detection means are arranged on the wedging arms.

* * * * *